US009004626B2

(12) United States Patent
Tsuchiya et al.

(10) Patent No.: US 9,004,626 B2
(45) Date of Patent: Apr. 14, 2015

(54) RECORDING DEVICE, METHOD OF CONTROLLING A RECORDING DEVICE, AND A PROGRAM

(75) Inventors: Norio Tsuchiya, Komoro (JP); Akihiko Tsuchiya, Tomi (JP)

(73) Assignee: Seiko Epson Corporation, Tokyo (JP)

( * ) Notice: Subject to any disclaimer, the term of this patent is extended or adjusted under 35 U.S.C. 154(b) by 125 days.

(21) Appl. No.: 13/607,310

(22) Filed: Sep. 7, 2012

(65) Prior Publication Data

US 2013/0070008 A1 Mar. 21, 2013

(30) Foreign Application Priority Data

Sep. 15, 2011 (JP) ..... 2011-202212

(51) Int. Cl.

| | |
|---|---|
| ***B41J 2/195*** | (2006.01) |
| ***B41J 29/393*** | (2006.01) |
| ***B41J 2/175*** | (2006.01) |
| ***B41J 29/38*** | (2006.01) |

(52) U.S. Cl.

CPC ..... *B41J 2/175* (2013.01); *B41J 2/17566* (2013.01); *B41J 29/38* (2013.01); *B41J 2002/17589* (2013.01)

(58) Field of Classification Search

CPC .... B41J 2/175; B41J 2/17543; B41J 2/17566; B41J 2002/17566; B41J 2002/17569; B41J 2002/17589

USPC ..... 347/7, 14, 19, 42, 43, 85, 86, 100

See application file for complete search history.

(56) References Cited

U.S. PATENT DOCUMENTS

2010/0295883 A1* 11/2010 Saikawa ..... 347/7

FOREIGN PATENT DOCUMENTS

| | | |
|---|---|---|
| JP | 08-127122 A | 5/1996 |
| JP | 2003-001842 A | 1/2003 |

* cited by examiner

*Primary Examiner* — Geoffrey Mruk

(74) *Attorney, Agent, or Firm* — Kilpatrick Townsend & Stockton LLP

(57) ABSTRACT

A recording device has a cartridge that holds a first ink tank filled with ink, and a second ink tank that is filled with ink of the same color; an inkjet head that prints using a first nozzle row that ejects ink supplied from the first ink tank, and a second nozzle row that ejects ink supplied from the second ink tank; and recording control unit that prints on a recording medium by ejecting ink from the first nozzle row or the second nozzle row. The recording control unit determines which ink tank contains more ink, and ejects ink to print from the nozzle row connected to the ink tank containing the most ink.

22 Claims, 6 Drawing Sheets

RECORDING DEVICE, METHOD OF CONTROLLING A RECORDING DEVICE, AND A PROGRAM

BACKGROUND

1. Technical Field

The present invention relates to a recording device that prints by ejecting ink, a method of controlling the recording device, and a program.

2. Related Art

Inkjet recording devices include inkjet printers that have separate inkjet heads connected to two ink tanks, and record images by ejecting ink from one of the inkjet heads. See, for example, Japanese Unexamined Patent Appl. Pub. JP-A-H08-127122.

Recording devices that record images by ejecting ink as described above are designed so that cartridges having plural ink tanks each filled with the same color of ink can be installed, and a different nozzle row is connected to each ink tank. When thus configured and a problem occurs in any one of the nozzle rows, the same color of ink can still be ejected from another nozzle row, and device redundancy and availability can be improved. However, such recording devices must be able to control recording images appropriately according to the cartridge configuration.

SUMMARY

With consideration for the foregoing problem, the present invention enables desirably controlling a recording device according to the configuration of a cartridge that is installed in the recording device and has plural ink tanks each storing the same color of ink.

One aspect of the invention is a recording device including a cartridge that holds a first ink tank filled with ink, and a second ink tank that is filled with ink of the same color as the ink in the first ink tank; an inkjet head that prints using a first nozzle row that is connected to the first ink tank and ejects ink supplied from the first ink tank, and a second nozzle row that is connected to the second ink tank and ejects ink supplied from the second ink tank; and recording control unit that prints on a recording medium by ejecting ink from the first nozzle row or the second nozzle row, and when printing on the recording medium, determines whether the first ink tank or the second ink tank contains more ink, and prints by ejecting ink from the nozzle row connected to the ink tank containing the most ink.

When a cartridge having plural ink tanks each containing the same color of ink is installed to the recording device described above, the cartridge must be replaced when either one of the ink tanks becomes empty or near empty because the nozzles connected that one ink tank can no longer be cleaned. The cartridge must still be replaced at this time even if sufficient ink remains in the other ink tank and the same color of ink can be ejected from the other ink tank and images can be recorded, and there is room for improvement in terms of cost. Maintaining substantially the same amount of ink in each of the plural ink tanks filled with the same color of ink is also necessary in such recording devices.

To solve this problem, the invention ejects ink for image recording from the nozzles connected to the one of the plural ink tanks having the greatest amount of ink remaining, thereby suppressing a difference in the amount of ink in each ink tank and keeping the ink level as equal as possible. More specifically, the invention enables desirably controlling a recording device in which a cartridge having plural ink tanks each holding the same color of ink can be installed so that the amount of ink remaining in each ink tank is kept substantially equal.

Preferably in another aspect of the invention, the recording control unit receives a first control command for printing, and a second control command following the first control command, prints on the recording medium based on the received first control command and the second control command, determines whether the first ink tank or the second ink tank contains the most ink when receiving the second control command ends if the second control command is received while printing based on the received first control command, and prints based on the second control command by ejecting ink from the nozzle row connected to the ink tank determined to have the most remaining ink.

If a second control command for printing next is received while printing based on a first control command, this aspect of the invention determines which ink tank has the most ink left when receiving the control command for the next print job is finished. The ink tank containing the most ink is therefore determined after confirming that another image will be recorded, and the decision process can be simplified and processing efficiency improved compared with attempting to predict how much ink will be left in each ink tank when recording the image currently being recorded ends.

In another aspect of the invention, the recording control unit receives a first control command for printing, and a second control command following the first control command, prints on the recording medium based on the received first control command and the second control command, determines whether the first ink tank or the second ink tank contains the most ink when printing based on the first control command ends if the second control command is received while printing based on the received first control command, and prints based on the second control command by ejecting ink from the nozzle row connected to the ink tank determined to have the most remaining ink.

Because this aspect of the invention determines which ink tank has the most ink left when the current print job is completed if the control command for printing next is received while printing based on the first control command, the next image can be recorded using the ink tank that actually has the most ink left when printing starts next, and a uniform ink level can therefore be maintained more effectively in each ink tank.

In another aspect of the invention, the recording control unit receives a first control command for printing, and a second control command following the first control command, prints on the recording medium based on the received first control command and the second control command, determines whether the first ink tank or the second ink tank contains the most ink when receiving the second control command starts if the second control command is received while printing based on the received first control command, and prints based on the second control command by ejecting ink from the nozzle row connected to the ink tank determined to have the most remaining ink.

If the control command for printing next is received while printing based on the first control command, this aspect of the invention determines which ink tank has the most ink left when receiving the control command for printing next starts. As a result, the decision can be made and the next printing process can start earlier than when the decision is made after recording the current image is completed or when the decision is made after receiving the control command for recording the next image is completed, and the process can also be simplified and processing efficiency improved compared with attempting to predict how much ink will be left in each ink tank when recording the image currently being recorded ends.

In another aspect of the invention, the recording control unit receives a first control command for printing, and a second control command following the first control command, prints on the recording medium based on the received first control command and the second control command, estimates the amount of ink that will be left in the first ink tank when printing based on the first control command ends, and compares the estimated amount of ink in the first ink tank with the amount of ink in the second ink tank to determine which ink tank contains the most ink if the second control command is received while ejecting ink from the first nozzle row and printing based on the received first control command, and prints based on the second control command by ejecting ink from the nozzle row connected to the ink tank determined to have the most remaining ink.

When a control command for printing next is received while printing based on a previous command, the recording control unit estimates the amount of ink that will be left in each ink tank after the current print job ends, and at the same time predicts the ink tank with the most remaining ink. The ink tank containing the most ink can therefore be used for printing when starting to record the next image, and a uniform level of ink in each ink tank can therefore be more effectively controlled. The ink tank containing the most ink can also be determined sooner and the next printing process can be started sooner than when the ink tank containing the most ink is determined after the current print job ends.

Further preferably in another aspect of the invention, the recording control unit flushes the first nozzle row and second nozzle row when the time for which ink is not ejected exceeds a specific time; and to print on the recording medium, determines if the time for which ink has not been ejected by either the first nozzle row or the second nozzle row is near this specific time when a control command is received, and prints by ejecting ink from the nozzle row that is near this time.

Flushing is an operation that requires a specific amount of time and consumes ink, and is therefore performed as infrequently as possible because of process efficiency and cost considerations. As a result, when the time since ink was last ejected is near this specific time for any one of the plural nozzle rows, this aspect of the invention ejects ink from that nozzle row to print regardless of how much ink remains in the ink tanks, thus gives preference to flushing the nozzle row over maintaining an equal ink level, and therefore meets the foregoing need to minimize nozzle flushing.

Another aspect of the invention is a method of controlling a recording device, including steps of: receiving a control command to print on a recording medium; determining whether a first ink tank that is held in a cartridge, is filled with ink, and is connected to a first nozzle row, or a second ink tank that is held in the cartridge, is filled with ink of the same color as the ink in the first ink tank, and is connected to a second nozzle row, has the most remaining ink; and printing by ejecting ink from the nozzle row connected to the ink tank determined to have the most remaining ink.

When printing, this control method prints by ejecting ink from the nozzles connected to the ink tank having the most ink left selected from among the plural ink tanks, and can therefore maintain a substantially equal level of ink in each of the ink tanks. A recording device in which a cartridge holding plural ink tanks each containing the same color of ink can be installed can therefore be controlled appropriately to the cartridge configuration when printing.

Another aspect of the invention is a program that is executed by a control unit that controls a recording device having a cartridge that holds a first ink tank filled with ink, and a second ink tank that is filled with ink of the same color as the ink in the first ink tank, and an inkjet head that prints using a first nozzle row that is connected to the first ink tank and ejects ink supplied from the first ink tank, and a second nozzle row that is connected to the second ink tank and ejects ink supplied from the second ink tank, the program causing the control unit to function as a recording control unit that, when printing on the recording medium, determines whether the first ink tank or the second ink tank contains more ink, and prints by ejecting ink from the nozzle row connected to the ink tank containing the most ink.

By executing this program when printing, this control method prints by ejecting ink from the nozzles connected to the ink tank having the most ink left selected from among the plural ink tanks, and can therefore maintain a substantially equal level of ink in each of the ink tanks. A recording device in which a cartridge holding plural ink tanks each containing the same color of ink can be installed can therefore be controlled appropriately to the cartridge configuration when printing.

The invention can also be embodied as a storage medium that stores the program readably by the control unit or a computer.

A recording device to which a cartridge holding a plurality of ink tanks each containing ink of the same color according to the invention can be controlled appropriately to the cartridge configuration when recording.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
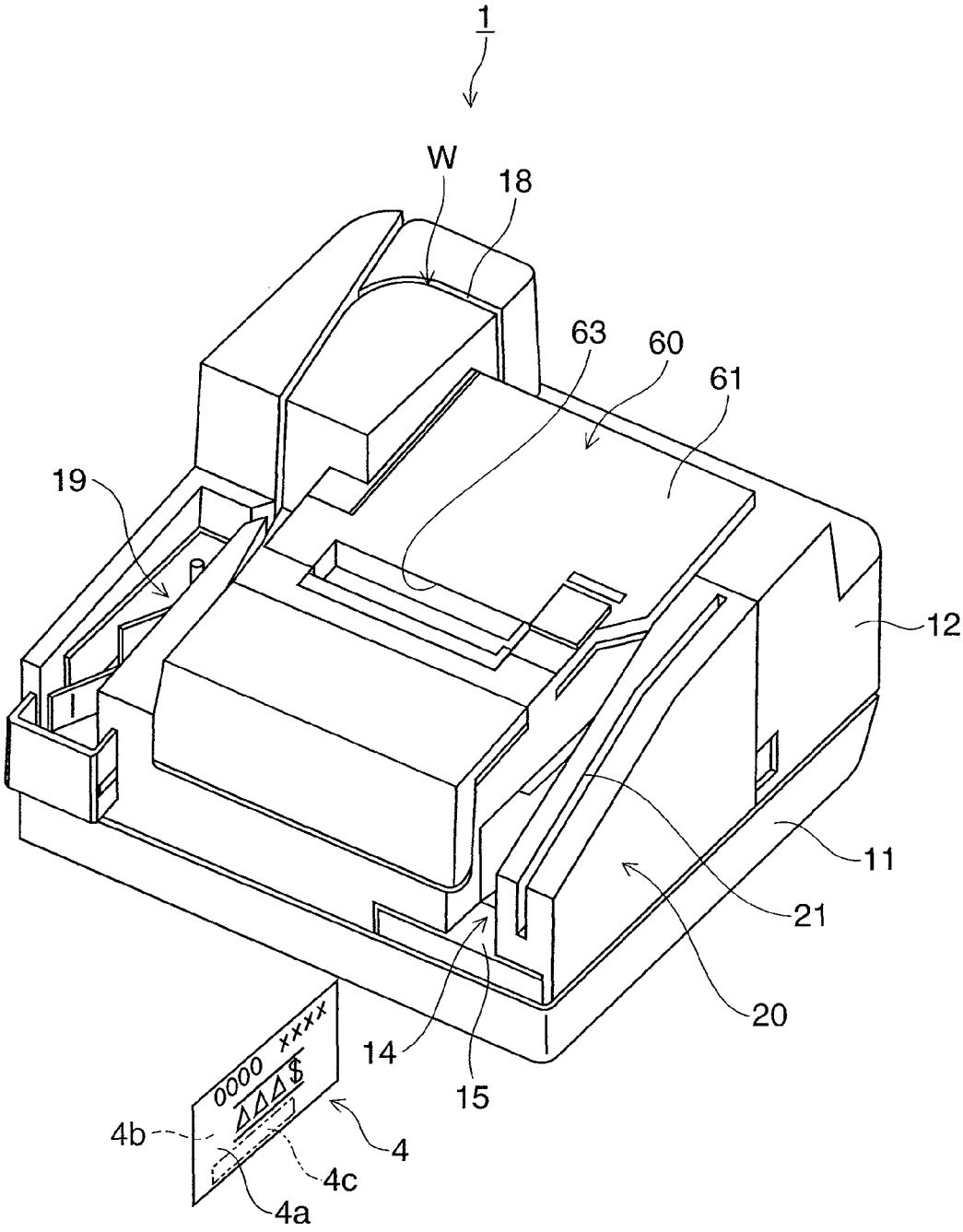
FIG. 1 is an external oblique view of a multifunction device according to a preferred embodiment of the invention.

FIG. 1 is an external oblique view of a multifunction device 1 (recording device) according to this embodiment of the invention.

The multifunction device 1 is a device that can process checks 4 (recording media) and forms as examples of recording media to be read and processed in multiple ways, including reading magnetic ink characters printed on the recording medium, optically imaging (scanning) both sides of the recording medium, and recording (printing) images including text on the recording medium. The multifunction device 1 also functions as a card reader that reads magnetic information recorded on card media such as credit cards, and functions to produce specific types of tickets with an image recorded thereon by recording an image to thermal roll paper and cutting the paper.

This embodiment of the invention describes processing checks 4 as an example of the processed medium. As shown in FIG. 1, a check 4 is a form having a payment amount, payee, serial number, payer signature, and other information printed on a sheet (paper) with a specific colored or patterned background. The payment amount, payee, serial number, payer signature, and other information are printed on the face 4*a*, and an endorsement area is provided on the back 4*b*. An endorsement is printed with specific text or an image in the endorsement area by the inkjet head 10 described below. An MICR (magnetic ink character recognition) line 4*c* is preprinted along the length of the check 4 on the face 4*a*. The MICR line 4*c* is a line of magnetic ink characters printed with magnetic ink, and can be read magnetically and optically. The lengths of the short and long sides of a check 4 are standardized, but can be of various different sizes because there are different standards. The multifunction device 1 according to this embodiment of the invention defines a maximum check size that includes substantially all commonly used sizes of checks 4, and can process any check 4 within this maximum size.

The outside case of the multifunction device 1 includes a bottom case 11 that covers the bottom part of the multifunction device 1, and a cover 12 that covers the bottom case 11, and the main parts of the multifunction device 1 are housed inside this outside case. An entrance 14 for inserting checks 4 is open at the front of the multifunction device 1, and a stacker 15 that can hold a stack of plural checks 4 is provided inside the entrance 14. The stacker 15 can be pulled out to the front, and the checks 4 can be loaded into the stacker 15 after adjusting the stacker 15 to the size of the checks 4 to be stored in the stacker 15.

A slot 18 that is substantially U-shaped when seen from above and is used as the conveyance path W of the checks 4 is formed in the cover 12, and the slot 18 ends in an exit pocket 19 at the front of the multifunction device 1. Checks 4 stored in the stacker 15 are fed one by one into the multifunction device 1 as described below, are processed as they pass through the slot 18, and the processed checks 4 are discharged into the exit pocket 19. Multiple checks 4 can accumulate in the exit pocket 19.

As shown in FIG. 1, a magnetic card reader 20 is disposed beside the stacker 15. The magnetic card reader 20 includes a card slot 21 formed in the cover 12, and a MCR (magnetic card reader) head 22 (FIG. 4) disposed facing the card slot 21, and reads information magnetically recorded on cards passing through the card slot 21 with the MCR head 22.

Figure 2:
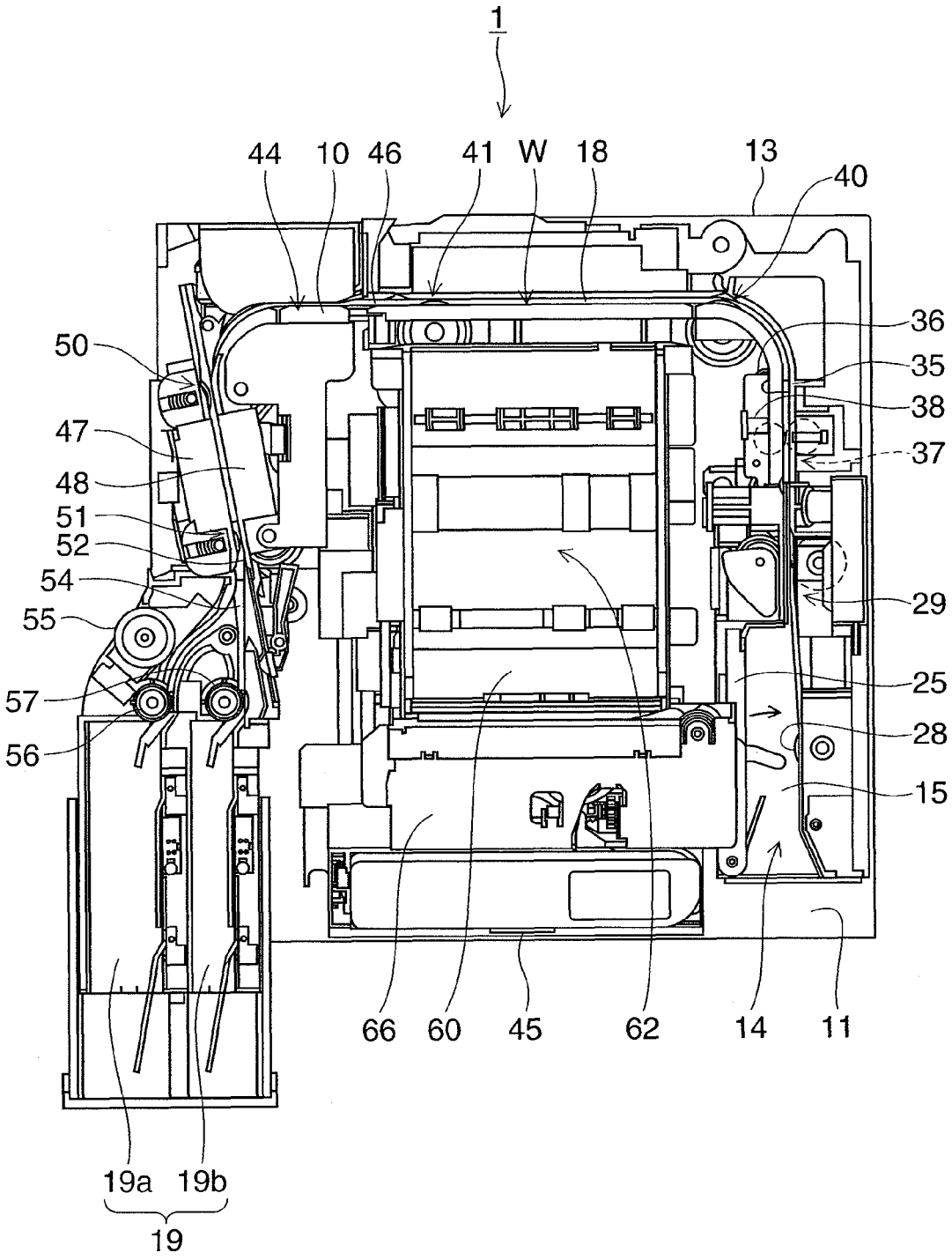
FIG. 2 is a plan view of the multifunction device.

FIG. 2 is a plan view showing the configuration of the main unit of the multifunction device 1 housed the outside case. A hopper 25 is disposed on one side of the stacker 15. The hopper 25 can pivot in the direction of the arrow by means of a hopper drive motor 26 (FIG. 4), and pushes the checks 4 in the stacker 15 to the other side.

A pickup roller 28 driven by an ASF (automatic [sic] sheet feeder) motor 27 described below is disposed on the other side of the stacker 15, and when the hopper 25 rotates toward the pickup roller 28, one check 4 in the stacker 15 is urged by this rotation to the pickup roller 28, contacts the roller, and is fed into the conveyance path W by rotation of the pickup roller 28.

An ASF roller set 29 composed of a pair of rollers is disposed downstream from the stacker 15. The two rollers of the ASF roller set 29 are disposed on opposite sides of the conveyance path W, one roller is driven by the ASF motor 27, and the other roller is a follower roller. The check 4 in contact with the pickup roller 28 is nipped by the ASF roller set 29, and conveyed downstream through the slot 18.

An ASF paper detector 31 (FIG. 4) is disposed to a specific position in the stacker 15. The ASF paper detector 31 is a transmissive photosensor in this embodiment, and detects if a check 4 is in the stacker 15.

A hopper position detector 32 (FIG. 4) is disposed at the standby position of the hopper 25 in the stacker 15. The hopper position detector 32 is a transmissive photosensor in this embodiment, and detects if the hopper 25 is in the standby position.

A MICR (magnetic ink character recognition) head 35 that contacts the face 4*a* of the check 4 and magnetically reads the MICR line 4*c* (FIG. 1) is disposed downstream from the ASF roller set 29. A MICR roller 36 is disposed opposite the MICR head 35. The MICR roller 36 is pushed to the MICR head 35 side, rotates while pressing the check 4 against the MICR head 35, and conveys checks 4 at a constant speed suited to reading the MICR line. An assist roller set 37 composed of a pair of rollers that guide the check 4 fed by the ASF roller set 29 to the MICR head 35 is disposed on the upstream side of the MICR head 35.

A paper length detector 38 is disposed to the conveyance path W between the assist roller set 37 and MICR head 35. The paper length detector 38 is a reflective photosensor in this embodiment, and detects the leading end and trailing end of each check 4 by detecting if a check 4 passing through the conveyance path W is at the detection position. The control unit 70 acquires the output signals of the paper length detector 38 and determines the length of the check 4 based on change in detector output.

A first conveyance roller set 40 including a pair of rollers disposed on opposite sides of the conveyance path W is disposed to the conveyance path W on the downstream side of the MICR head 35, and a second conveyance roller set 41 is disposed downstream from the first conveyance roller set 40. The first conveyance roller set 40 and second conveyance roller set 41 are driven rotationally by a conveyance motor 42 (FIG. 4), and these rollers convey the check 4 to the inkjet printer unit 44.

The inkjet printer unit 44 has an inkjet head 10. The inkjet head 10 is an inkjet recording head that is supplied with ink from an ink cartridge 45 installed in the front of the main unit 13 and ejects ink onto the check 4. The inkjet head 10 is an inkjet line head. When recording on a check 4, ink is ejected from the stationary inkjet head 10 to the back 4*b* of the check 4 conveyed at a constant speed, and an image is recorded. The image recorded on the back 4*b* of the check 4 is an endorsement including text or symbols.

An intermediate detector 46 is disposed between the inkjet head 10 and second conveyance roller set 41. The intermediate detector 46 is a reflective photosensor in this embodiment, and detects if a check 4 is at the detection position.

Figure 3:
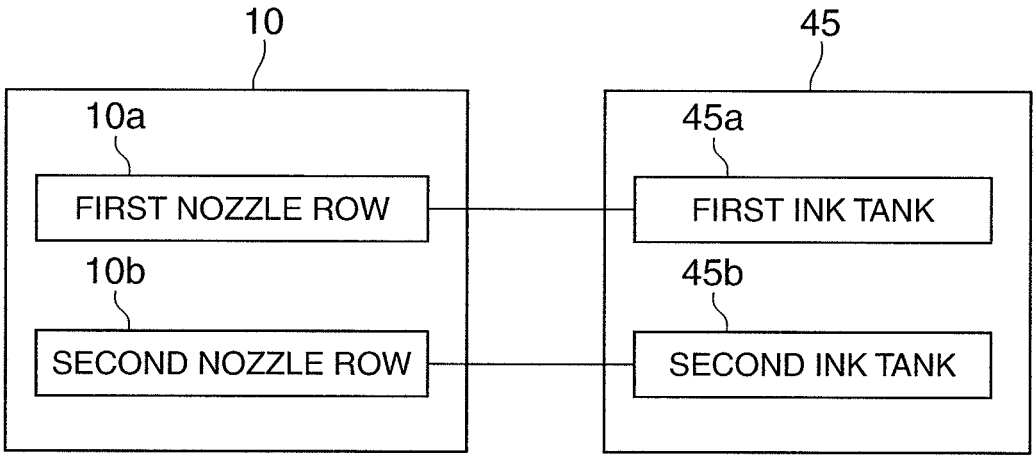
FIG. 3 shows the relationship between the inkjet head and ink cartridge.

FIG. 3 schematically describes the relationship between the inkjet head 10 and ink cartridge 45.

The inkjet head 10 is a substrate with a first nozzle row 10*a* (nozzle row) and a second nozzle row 10*b* (nozzle row). The first nozzle row 10*a* and second nozzle row 10*b* are rows of plural nozzles each extending in a direction (the short side of the conveyed check 4) perpendicular to the conveyance direction of a check 4 travelling through the conveyance path W.

The ink cartridge 45 (cartridge) includes a first ink tank 45*a* (ink tank) and a second ink tank 45*b* (ink tank). The first ink tank 45*a* and second ink tank 45*b* are both filled with the same color of ink (black in this embodiment). The first nozzle row 10*a* is connected to the first ink tank 45*a*, and ejects ink stored in the first ink tank 45*a*. The second nozzle row 10*b* is connected to the second ink tank 45*b*, and ejects ink stored in the second ink tank 45*b*.

When recording an image on one check 4, the inkjet head 10 ejects ink exclusively from either the first nozzle row 10*a* or the second nozzle row 10*b* to record an image.

The ink cartridge 45 in this embodiment of the invention thus holds two ink tanks, first ink tank 45*a* and second ink tank 45*b*, and both ink tanks are filled with the same color of ink. This configuration has the following merits.

Specifically, if a problem develops with nozzles in either first nozzle row 10*a* or second nozzle row 10*b*, the same color of ink can still be ejected by the other nozzle row, and device redundancy and availability can be improved. More specifically, because the multifunction device 1 according to this embodiment of the invention is a device for processing checks 4, which are a type of important form, greater redundancy and availability for printing on the checks 4 is required than in a multifunction device that can be used by an indiscriminate group of people, and the multifunction device 1 can desirably meet this need.

Note that two-color printing is possible when an ink cartridge 45 having the first ink tank 45*a* and second ink tank 45*b* filled with different colors of ink is used.

Referring again to FIG. 2, a CIS (contact image sensor) unit for optically reading checks 4 is disposed downstream from the inkjet head 10. This CIS unit includes a front CIS unit 47 for imaging the face 4*a* of the check 4, and a back CIS unit 48 for imaging the back 4*b*, and can thus optically image both sides of each check 4. The front CIS unit 47 and back CIS unit 48 are disposed on opposite sides of the conveyance path W. A first CIS roller 50 is disposed on the upstream side and a second CIS roller 51 is disposed on the downstream side of these units. The first CIS roller 50 and second CIS roller 51 are rollers that are driven rotationally by the conveyance motor 42, and checks 4 are conveyed by these rollers at a constant speed while being imaged by the CIS units.

A discharge detector 52 is located downstream from the second CIS roller 51. The discharge detector 52 is a reflective photosensor in this embodiment, and detects if a check 4 is at the detection position.

The exit pocket 19 described above is located downstream from the front CIS unit 47 and back CIS unit 48. The exit pocket 19 is divided into a main pocket 19*a* and a sub-pocket 19*b*, and the slot 18 splits and is connected to both the main pocket 19*a* and sub-pocket 19*b*. The main pocket 19*a* and sub-pocket 19*b* can each hold a plurality of checks 4.

A flapper 54 that switches the exit pocket 19 into which the check 4 is discharged to the main pocket 19*a* or sub-pocket 19*b* is disposed at the position where the slot 18 splits. The flapper 54 is a guide that by closing the path to the main pocket 19*a* or the path to the sub-pocket 19*b* guides the check 4 into the other pocket, and is driven by the flapper drive motor 55. A discharge roller 56 is disposed to the path from the flapper 54 to the main pocket 19*a*, another discharge roller 56 is disposed to the path from the flapper 54 to the sub-pocket 19*b*, and the checks 4 are thus smoothly discharged by these rollers and guided by the flapper 54 into the appropriate exit pocket 19.

As described below, the multifunction device 1 discharges the check 4 into the main pocket 19*a* when the check 4 is determined to have been correctly loaded based on the result of the MICR head 35 reading the MICR line 4*c*, and into the sub-pocket 19*b* when the check 4 is determined to have not been correctly loaded.

As shown in FIG. 1 and FIG. 2, a thermal printer unit 60 for printing tickets with an image recorded thereon is provided in the middle of the multifunction device 1.

A shown in FIG. 1, the thermal printer unit 60 has a printer cover 61 covering the top of the multifunction device 1. This printer cover 61 is attached to the cover 12 so that the printer cover 61 can open and close freely. When the printer cover 61 is open, a roll paper compartment 62 (FIG. 2), which is a space for holding thermal roll paper, is exposed and the thermal roll paper can be installed or replaced. A paper exit 63 is formed in the printer cover 61, and the thermal roll paper held in the roll paper compartment 62 can be discharged through the paper exit 63.

The thermal printer unit 60 includes a roller platen (not shown in the figure) that supplies and feeds thermal roll paper from the roll paper compartment 62, a thermal head 65 (FIG. 4) disposed opposite the platen, and a cutter unit 66 that cuts the thermal roll paper perpendicularly to the conveyance direction. To produce a ticket, the thermal printer unit 60 records an image on the thermal roll paper with the thermal head 65 while driving the platen and conveying the thermal roll paper in the conveyance direction, and then cuts the thermal roll paper at a specific position with the cutter unit 66 to produce a ticket.

Figure 4:
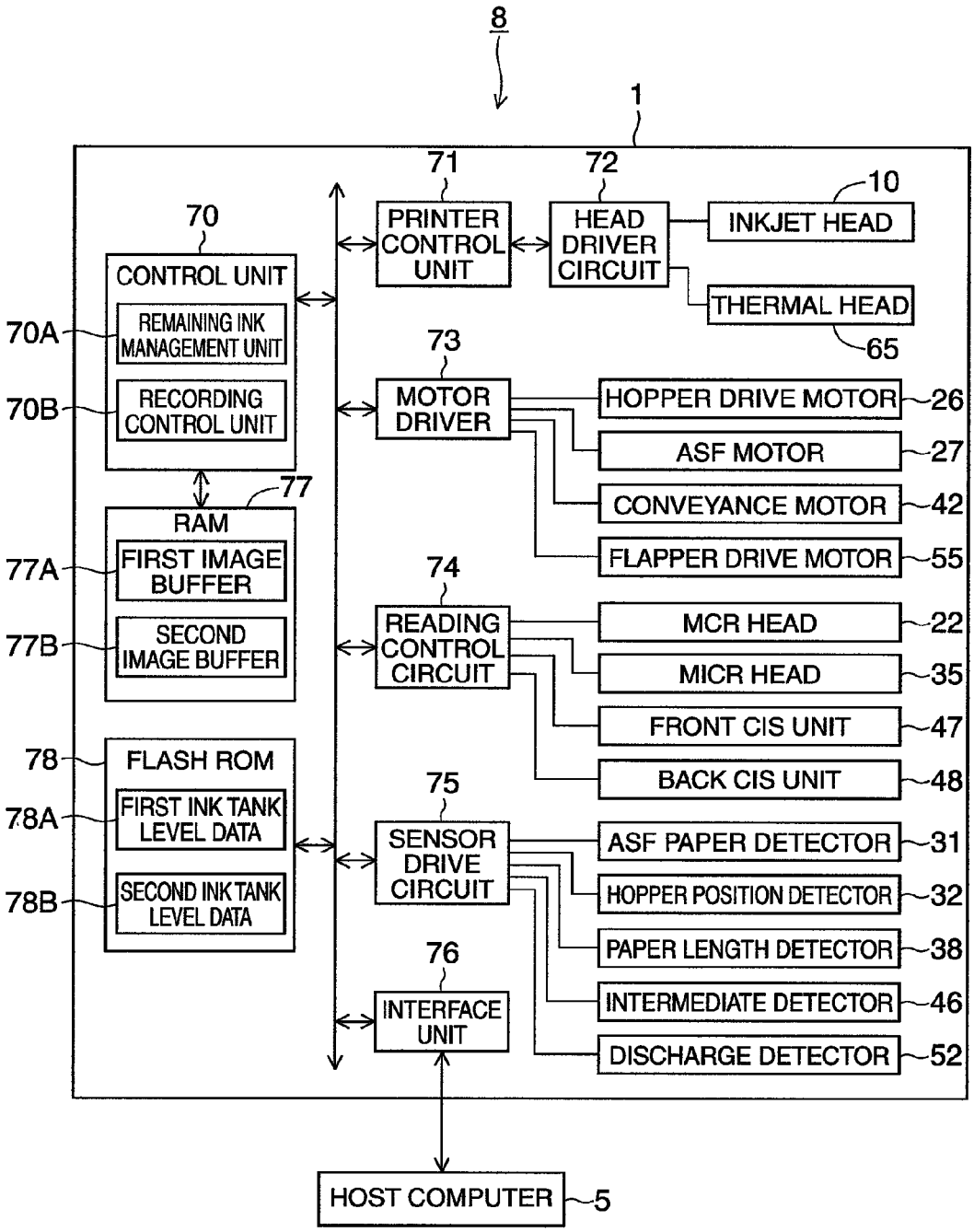
FIG. 4 is a function block diagram showing the configuration of the recording system.

FIG. 4 is a block diagram showing the functional configuration of a recording system 8 composed of the multifunction device 1 connected to a host computer 5.

The multifunction device 1 includes a control unit 70, flash ROM 78, printer control unit 71, head driver circuit 72, motor driver 73, reading control circuit 74, sensor drive circuit 75, and interface unit 76, which are connected so that they can communicate with each other.

The control unit 70 includes a CPU and peripheral circuits, and centrally controls the other parts of the multifunction device 1 by means of the CPU reading and running a control program stored in flash ROM 78 described below. The control unit 70 includes a remaining ink management unit 70A and recording control unit 70B as described below.

The control unit 70 is connected to RAM 77, which functions as working memory and includes a first image buffer 77A and a second image buffer 77B. These image buffers are further described below.

The flash ROM 78 nonvolatilely stores data rewritably. In addition to the control program described above, flash ROM 78 also stores first ink tank level data 78A and second ink tank level data 78B. This data is further described below.

The printer control unit 71 supplies drive current to the inkjet head 10 through the head driver circuit 72 to record on a check 4 as controlled by the control unit 70. The printer control unit 71 also supplies drive current to the thermal head 65 through the head driver circuit 72 to record on thermal roll paper as controlled by the control unit 70.

The motor driver 73 is connected to the hopper drive motor 26 and causes the hopper 25 to pivot as controlled by the control unit 70.

The motor driver 73 is connected to the ASF motor 27 and conveyance motor 42, outputs drive current and drive pulses to the motors, and operates the motors to drive the rollers connected to the motors and convey the check 4 through the conveyance path W as controlled by the control unit 70.

The motor driver 73 is connected to the flapper drive motor 55, outputs drive current and drive pulses to the motor, and drives the motor to switch the flapper 54 to the main pocket 19*a* or sub-pocket 19*b* side as controlled by the control unit 70.

The reading control circuit 74 is connected to the MCR head 22, MICR head 35, front CIS unit 47, and back CIS unit 48.

The reading control circuit 74 causes the MCR head 22 to read the magnetic information when a card is swiped through the card slot 21 (FIG. 1), and digitizes and outputs the read signal output from the MCR head 22 to the control unit 70 as controlled by the control unit 70.

The reading control circuit 74 also reads magnetic information with the MICR head 35, and digitizes and outputs the read signal output from the MICR head 35 to the control unit 70 as controlled by the control unit 70.

The reading control circuit 74 also images the face 4*a* and back 4*b* of the check 4 with the front CIS unit 47 and back CIS unit 48 as controlled by the control unit 70, and digitizes and outputs the signals output from the front CIS unit 47 and back CIS unit 48 to the control unit 70.

The sensor drive circuit 75 is connected to the ASF paper detector 31, hopper position detector 32, paper length detector 38, intermediate detector 46, and discharge detector 52, supplies current to these detectors, gets the output values therefrom at specific times, and digitizes and outputs the acquired detection signals to the control unit 70.

The interface unit 76 is connected to the host computer 5 by wire or wirelessly, and exchanges data, including control data, with the host computer 5 as controlled by the control unit 70.

The basic operation of the multifunction device 1 when processing one check 4 is described next with reference to the flow chart in FIG. 5.

When a control command to start processing a check 4 is received from the host computer 5 (step S11), the control unit 70 of the multifunction device 1 drives the hopper drive motor 26 and ASF motor 27 while monitoring the output values of the hopper position detector 32 and ASF paper detector 31, feeds one check 4 from the stacker 15 into the conveyance path W, and starts check 4 conveyance (step S12).

Next, the control unit 70 reads the MICR line 4*c* of the check 4 with the MICR head 35 while managing the position of the check 4 by monitoring the output from the paper length detector 38 (step S13).

Next, based on the output from the MICR head 35, the control unit 70 determines if the check 4 was loaded correctly instead of backwards top-bottom or front-back (step S14). More specifically, the control unit 70 applies magnetic ink character recognition to the magnetic ink characters in the MICR line 4*c* by comparing the waveforms obtained by reading the magnetic ink characters with standard waveforms, and determines if the check 4 was loaded correctly or not based on whether or not magnetic ink character recognition is successful.

Next, the control unit 70 drives the flapper drive motor 55 to switch the flapper 54 as required based on the result from step S14 (step S15). More specifically, if the check 4 was loaded correctly, the control unit 70 switches the flapper 54 to the main pocket 19*a* side, and if the check 4 was not loaded correctly, the control unit 70 switches the flapper 54 to the sub-pocket 19*b* side. Note that steps S14 and S15 could run parallel to steps S16 to S18 described below.

Next, the control unit 70 drives the rollers by driving the conveyance motor 42 to convey the check 4 while monitoring the position of the check 4 by monitoring output from the intermediate detector 46, and records a specific image on the back 4*b* of the check 4 with the inkjet head 10 (step S16). The operation of step S16 is further described below. Note that if the check 4 was not loaded correctly, recording an image in step S16 may be skipped.

The control unit 70 then scans the face 4*a* of the check 4 with the front CIS unit 47 while scanning the back 4*b* with the back CIS unit 48 (step S17), and outputs the scanned images to the host computer 5. Note that if the check 4 was not loaded correctly, scanning in step S17 may be skipped.

The control unit 70 then drives the rollers by driving the conveyance motor 42 to discharge the check 4 into the appropriate exit pocket 19 while monitoring whether or not the check 4 was discharged correctly by monitoring the output of the discharge detector 52 (step S18). The check 4 is guided at this time by the flapper 54 into the appropriate exit pocket 19, that is, the main pocket 19*a* or sub-pocket 19*b*, based on the result of reading by the MICR head 35.

Figure 5:
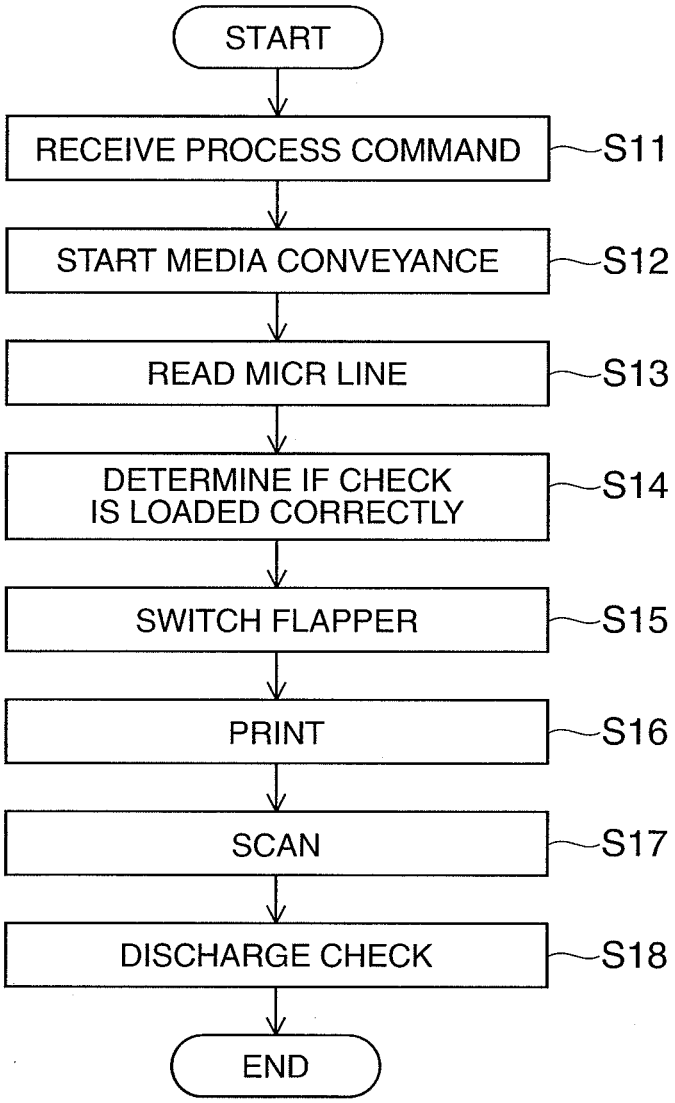
FIG. 5 is a flow chart of the operation of the multifunction device.

When plural checks 4 are in the stacker 15, the multifunction device 1 according to this embodiment of the invention can process the checks 4 by repeating the process shown in FIG. 5 continuously. More specifically, the multifunction device 1 sequentially feeds the plural checks 4 from the stacker 15 at appropriate times into the conveyance path W, and applies the process described above to the checks 4 one by one.

The remaining ink management unit 70A of the control unit 70 is described next.

The function of the remaining ink management unit 70A is achieved by the cooperation of hardware and software, such as the CPU reading and running a control program stored in flash ROM 78.

The remaining ink management unit 70A manages the amount of ink left in both the first ink tank 45*a* and second ink tank 45*b*.

More specifically, the remaining ink management unit 70A counts the number of ink shots ejected from the nozzles of the first nozzle row 10*a* after the ink cartridge 45 is installed, and based on the number of shots calculates the amount of ink ejected since the cartridge was installed. The remaining ink management unit 70A also considers the amount of ink ejected for uses other than printing, such as cleaning and flushing operations described below, to calculate how much ink was ejected. The remaining ink management unit 70A then subtracts the calculated amount of ink ejected from the initial amount of ink in a full first ink tank 45*a* to get the amount of ink remaining in the first ink tank 45*a*. The remaining ink management unit 70A then stores the remaining amount of ink in the first ink tank 45*a* that was calculated as the first ink tank level data 78A in flash ROM 78. The remaining ink management unit 70A updates the first ink tank level data 78A to reflect how much ink was ejected every time ink is ejected from the first nozzle row 10*a* and the amount of ink left in the first ink tank 45*a* changes. The remaining amount of ink in the first ink tank 45*a* denoted by the first ink tank level data 78A therefore always reflects the actual current amount of ink remaining.

The remaining ink management unit 70A manages the remaining amount of ink in the second ink tank 45*b* in the same way.

When the amount of ink left in the first ink tank 45*a* goes to or below a specific level, the remaining ink management unit 70A stores ink end information indicating that the remaining amount of ink is less than the threshold in the first ink tank level data 78A stored in flash ROM 78. This specific value is the value used as a threshold for determining if there is enough ink left for the cleaning process described. The remaining ink management unit 70A likewise stores ink end information in the second ink tank level data 78B when the ink level in the second ink tank 45*b* goes to or below the specific level.

When the remaining amount of ink goes below the threshold for either the first ink tank 45*a* or second ink tank 45*b*, the multifunction device 1 according to this embodiment of the invention reports the same to the host computer 5 and at least stops the recording operation of the inkjet head 10. The reason for this is described below.

The multifunction device 1 according to this embodiment of the invention also cleans and flushes the inkjet head 10 as needed.

Cleaning is an operation that forcibly removes ink left in the nozzles to prevent problems ejecting ink from the nozzles as a result of ink left inside the nozzles of the first nozzle row 10*a* and second nozzle row 10*b* increasing in viscosity over time.

For cleaning, the control unit 70 moves a cap not shown and covers the nozzle face of the inkjet head 10 with the cap. The control unit 70 then drives a pump not shown that is connected to the cap to apply negative pressure to the nozzle faces of the first nozzle row 10*a* and second nozzle row 10*b* of the inkjet head 10 and forcibly suction ink from inside the nozzles.

Because of their construction, ink must be suctioned simultaneously from the first nozzle row 10*a* and second nozzle row 10*b* during cleaning, and the amount of ink required for cleaning must therefore be left in both the first ink tank 45*a* and second ink tank 45*b*. If there is not enough ink for cleaning left, the nozzles could be adversely affected by suction.

Therefore, when the remaining amount of ink goes below the specific amount that is the threshold for determining if the amount of ink required for cleaning remains, the multifunction device 1 according to this embodiment of the invention reports the same to the host computer 5 and at least stops recording with the inkjet head 10. In this case, the user must replace the ink cartridge 45 with a new ink cartridge 45.

Flushing is an operation that is performed to prevent an increase in the viscosity of ink left inside the nozzles of the first nozzle row 10*a* and second nozzle row 10*b*.

In the flushing operation the control unit 70 causes the nozzles of the first nozzle row 10*a* and second nozzle row 10*b* to eject a specific volume of ink a specific number of times into the cap not shown to replace the ink inside the nozzles with fresh ink.

This embodiment of the invention flushes the nozzles when a predetermined specific amount of time (the "flushing time" below) has past since the last time ink was ejected from the first nozzle row 10*a* and second nozzle row 10*b*. Because ink is known to increase in viscosity over time, flushing effectively suppresses increase in the viscosity of ink left in the nozzles. The recording control unit 70B described below monitors the amount of time since ink was last ejected from the first nozzle row 10*a* or second nozzle row 10*b* during multifunction device 1 operation, and flushes the nozzles when the amount of time passed since ink was ejected from either nozzle row reaches the flushing time.

When a cartridge having plural ink tanks each filled with the same color of ink is installed as in the multifunction device 1 according to this embodiment of the invention, and the amount of ink in any one ink tank goes below the specific threshold, the nozzles connected to that ink tank cannot be cleaned, and the ink cartridge 45 must be replaced. The ink cartridge 45 must still be replaced at this time even if sufficient ink remains in the other ink tank and the same color of ink can be ejected from the other ink tank and images can be recorded, and there is room for improvement in terms of cost. Preventing uneven consumption of ink so that the amount of ink left in the first ink tank 45*a* and second ink tank 45*b* is substantially equal at all times is therefore necessary.

The multifunction device 1 according to this embodiment of the invention achieves this by executing the following operation in step S16 in FIG. 5.

Figure 6:
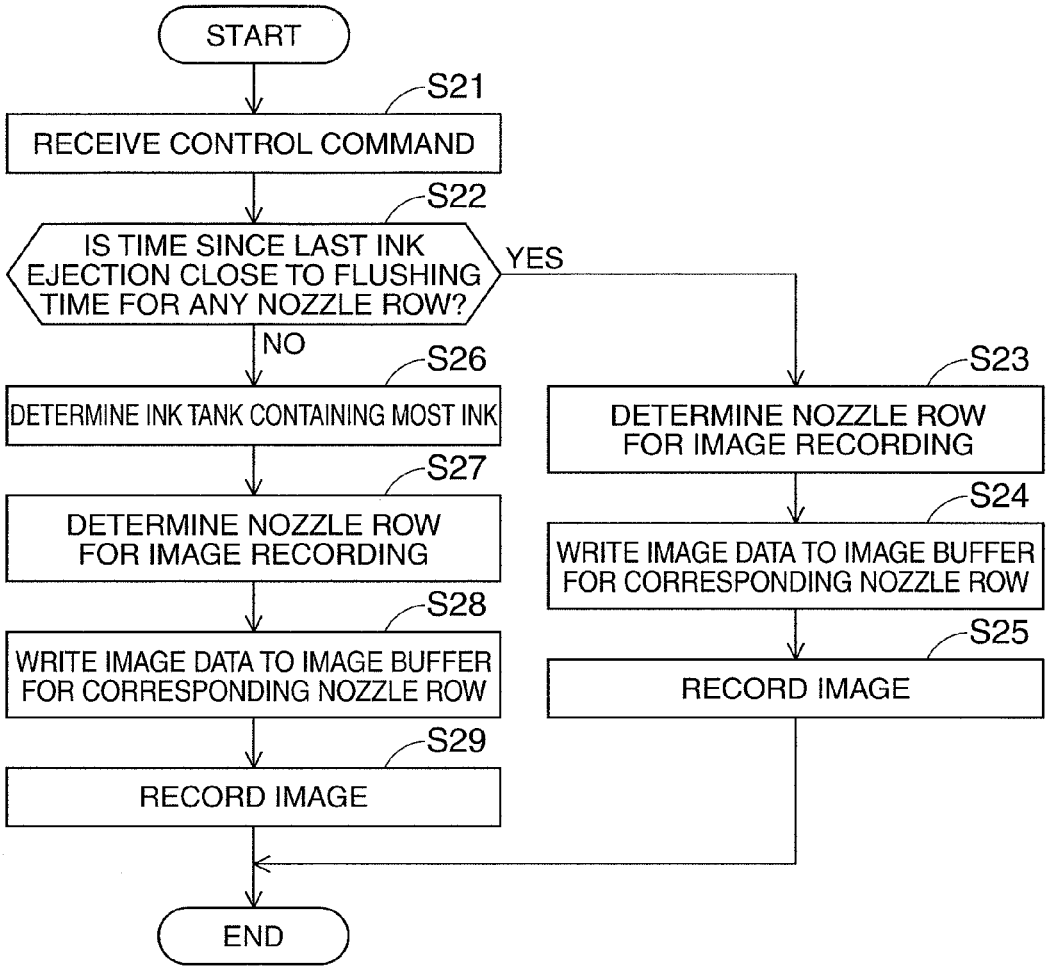
FIG. 6 is a flow chart of the operation of the multifunction device.

FIG. 6 is a flow chart of the operation of the multifunction device 1 when recording an image on a check 4 in step S16 in FIG. 5.

To record an image on a check 4, a control command for recording an image is input from the host computer 5 to the multifunction device 1 (step S21). The control command includes image data (data including information related to the color of each pixel, such as bitmap data) for the image to be recorded on the check 4.

The recording control unit 70B of the control unit 70 of the multifunction device 1 then determines if the time since the last time ink was ejected from the first nozzle row 10*a* or second nozzle row 10*b* is close to the flushing time (step S22). A time close to the flushing time is a predetermined time that is shorter than the flushing time and approaching the flushing time, such as 4 minutes 40 seconds if the flushing time is 5 minutes.

If the time since the last time ink was ejected from the first nozzle row 10*a* or second nozzle row 10*b* is near the flushing time (step S22 returns Yes), the recording control unit 70B selects that nozzle row as the nozzle row used to record the image (step S23). As described above, when recording an image on any particular single check 4, the inkjet head 10 exclusively ejects ink from first nozzle row 10*a* or second nozzle row 10*b* to record the image.

Next, the recording control unit 70B writes the image data to the image buffer corresponding to the nozzle row that will be used, either first nozzle row 10*a* or second nozzle row 10*b*, (step S24).

The image buffer corresponding to the nozzle row that will be used is, more specifically, first image buffer 77A when first nozzle row 10*a* is the nozzle row used, and second image buffer 77B when second nozzle row 10*b* is the nozzle row used. Dedicated buffers are reserved in RAM 77 for first nozzle row 10*a* and second nozzle row 10*b* in this embodiment, the image is recorded after writing the image data for the image to the first image buffer 77A when the image is recorded using the first nozzle row 10*a*, and the image is recorded after writing the image data for the image to the second image buffer 77B when the image is recorded using the second nozzle row 10*b*.

Next, the recording control unit 70B records the image to the check 4 conveyed through the conveyance path W using the nozzle row selected in step S23 at the appropriate timing based on the image data stored in the image buffer (step S25).

When the time past since the last time ink was ejected is close to the flushing time for either first nozzle row 10*a* or second nozzle row 10*b*, this embodiment thus records images by ejecting ink from the nozzle row that is close to the flushing time regardless of how much ink remains in the ink tanks. This has the following advantage.

Flushing is an operation that requires a specific amount of time and consumes ink, and is therefore performed as infrequently as possible because of process efficiency and cost considerations. Because this embodiment gives preference to flushing the nozzle row for which the time since the last ink ejection is close to the flushing time over consuming ink uniformly from both ink tanks, flushing this nozzle row can be avoided by using it to print, and the foregoing need to minimize nozzle flushing can be met. Note that step S22 can also be omitted. For example, when images are recorded continuously to a plurality of checks 4, control can go directly to step S23 skipping step S22.

If in step S22 the time since the last time ink was ejected is not near the flushing time for either first nozzle row 10*a* or second nozzle row 10*b* (step S22 returns No), that is, the time since the last time ink was ejected from both first nozzle row 10*a* and second nozzle row 10*b* is longer than the flushing time, control goes to the next step.

The recording control unit 70B then reads the first ink tank level data 78A and second ink tank level data 78B stored in the flash ROM 78, and determines which of first ink tank 45*a* and second ink tank 45*b* contains the most ink (step S26). The recording control unit 70B then selects the nozzle row connected to that ink tank as the nozzle row to use for image recording (step S27).

Next, the recording control unit 70B writes the image data to the image buffer corresponding to the nozzle row selected in step S27 to be used, either first nozzle row 10*a* or second nozzle row 10*b* (step S28), and then at the appropriate timing records the image to the check 4 conveyed through the conveyance path W using the nozzle row selected in step S27 based on the image data stored in the image buffer (step S29).

Because ink is ejected from the nozzle row connected to the ink tank that contains the most ink in the group of plural ink tanks when recording images in this embodiment, a difference in the remaining ink level can be suppressed and the amount of ink in each ink tank can be maintained substantially equal.

As described above, the multifunction device 1 according to this embodiment of the invention can continuously process a plurality of checks 4 stored in the stacker 15 with the operation described in the flow chart in FIG. 5. A control command for recording an image on the next check 4 could therefore be received while the multifunction device 1 is executing the process related to recording an image on one check 4 based on a previously received control command for recording an image.

In this case, the multifunction device 1 makes the decision shown as step S26 in FIG. 6, that is, deciding which ink tank holds the most ink, at the four times described below. Note that the user can set which of these times is used to make this decision. The control command referred to here is a command that includes controlling recording an image to a check 4.

Time 1

When a control command for recording the next image is received during a process related to recording an image based on a control command, the recording control unit 70B determines the ink tank with the most remaining ink when receiving the control command for recording the next image is completed (time 1). The next image is then recorded using the nozzle row connected to the ink tank identified at this time 1.

As a result, the decision is made after the control command for recording the next image has been completely received and recording a next image is confirmed. Executing this decision step unnecessarily can therefore be prevented when receiving the control command is not completed because control command output is interrupted or a communication error occurs, for example, and a next image will not be recorded. The process can also be simplified and processing efficiency improved compared with attempting to predict how much ink will be left in each ink tank when recording the image currently being recorded ends.

Time 2

When a control command for recording the next image is received during a process related to recording an image based on a control command, the recording control unit 70B determines the ink tank with the most remaining ink when recording the image currently being recorded is completed (time 2). The next image is then recorded using the nozzle row connected to the ink tank identified at this time 2.

Because the ink tank with the most ink left is determined after recording the image being recorded is completed, the next image can be recorded using the ink tank that actually contains the most ink when recording the next image starts, and ink can therefore be more reliably consumed equally from each ink tank.

Time 3

When a control command for recording the next image is received during a process related to recording an image based on a control command, the recording control unit 70B determines the ink tank with the most remaining ink when receiving the control command for recording the next image starts (time 3). The next image is then recorded using the nozzle row connected to the ink tank identified at this time 3.

Because the ink tank with the most remaining ink is determined when receiving the control command for recording the next image starts, the decision can be made earlier than when the decision is made after recording the current image is completed or when the decision is made after receiving the control command for recording the next image is completed. The image data for the next image can therefore be written to the appropriate image buffer more quickly when this decision results in the nozzle row used to record the next image being different from the nozzle row being used to record the current image. The process can also be simplified and processing efficiency improved compared with attempting to predict how much ink will be left in each ink tank when recording the image currently being recorded ends.

Time 4

When a control command for recording the next image is received during a process related to recording an image based on a control command, the recording control unit 70B estimates the amount of ink left in each ink tank after recording the current image ends, and determines the ink tank with the most remaining ink based on this estimate (time 4). The next image is then recorded using the nozzle row connected to the ink tank identified at this time 4.

Estimating how much ink will be left in each ink tank when recording the current image ends can be done, for example, by managing the amount of ink in each ink tank before image recording starts, calculating the amount of ink that must be ejected to record the image based on the image data for the image being recorded, and subtracting the calculated amount of ink from the amount of ink in the ink tank before image recording started.

This enables estimating the amount of ink that will be left in each ink tank when recording the current image ends if a control command for recording the next image is received while recording an image. Because the ink tank with the most ink left can be determined based on this estimate, the next image can be recorded using the ink tank containing the most amount of ink when recording the next image starts. An even amount of ink can also be more effectively maintained in each ink tank. The decision can also be made and the next image recording process can start sooner than when the ink tank containing the most ink is determined after recording the current image is completed.

As described above, a multifunction device 1 (recording device) according to this embodiment of the invention enables installing an ink cartridge 45 that can hold a plurality of ink tanks, first ink tank 45*a* and second ink tank 45*b*, each filled with the same color of ink, and a first nozzle row 10*a* and second nozzle row 10*b* that are connected and eject ink supplied from the respective ink tanks. To record an image on a check 4, the recording control unit 70B determines which of first ink tank 45*a* and second ink tank 45*b* has the most ink left, and records the image by ejecting ink from the nozzle row connected to the ink tank containing the most ink.

Because images are recorded by ejecting ink from the nozzle row connected to the ink tank with the most ink left in the group of plural ink tanks, a difference in the ink level in each ink tank can be suppressed and the ink levels can be kept substantially equal. As a result, problems such as needing to replace the ink cartridge 45 when sufficient ink remains in one of the ink tanks, first ink tank 45*a* or second ink tank 45*b*, can be prevented. More specifically, the multifunction device 1 according to this embodiment of the invention can control operation appropriately according to the configuration of the ink cartridge 45.

When a control command for recording the next image is received during a process related to recording an image based on a control command, the recording control unit 70B according to this embodiment of the invention can determine the ink tank with the most remaining ink when receiving the control command for recording the next image is completed. The next image is then recorded using the nozzle row connected to the ink tank identified at this time.

As a result, the decision is made after the control command for recording the next image has been completely received and recording a next image is confirmed. Executing this decision step unnecessarily can therefore be prevented when receiving the control command is not completed because control command output is interrupted or a communication error occurs, for example, and a next image will not be recorded. The process can also be simplified and processing efficiency improved compared with attempting to predict how much ink will be left in each ink tank when recording the image currently being recorded ends.

When a control command for recording the next image is received during a process related to recording an image based on a control command, the recording control unit 70B according to this embodiment of the invention can also determine the ink tank with the most remaining ink when recording the image currently being recorded is completed. The next image is then recorded using the nozzle row connected to the ink tank identified at this time.

Because the ink tank with the most ink left is determined after recording the image being recorded is completed, the next image can be recorded using the ink tank that actually contains the most ink when recording the next image starts, and ink can therefore be more reliably consumed equally from each ink tank.

When a control command for recording the next image is received during a process related to recording an image based on a control command, the recording control unit 70B according to this embodiment of the invention can also determine the ink tank with the most remaining ink when receiving the control command for recording the next image starts. The next image is then recorded using the nozzle row connected to the ink tank identified at this time.

Because the ink tank with the most remaining ink is determined when receiving the control command for recording the next image starts, the decision can be made earlier than when the decision is made after recording the current image is completed or when the decision is made after receiving the control command for recording the next image is completed. The image data for the next image can therefore be written to the appropriate image buffer more quickly when this decision results in the nozzle row used to record the next image being different from the nozzle row being used to record the current image. The process can also be simplified and processing efficiency improved compared with attempting to predict how much ink will be left in each ink tank when recording the image currently being recorded ends.

When a control command for recording the next image is received during a process related to recording an image based on a control command, the recording control unit 70B estimates the amount of ink left in each ink tank after recording the current image ends, and determines the ink tank with the most remaining ink based on this estimate. The next image is then recorded using the nozzle row connected to the ink tank identified at this time.

This enables estimating the amount of ink that will be left in each ink tank when recording the current image ends if a control command for recording the next image is received while recording an image. Because the ink tank with the most ink left can be determined based on this estimate, the next image can be recorded using the ink tank containing the most amount of ink when recording the next image starts. An even amount of ink can also be more effectively maintained in each ink tank. The decision can also be made and the next image recording process can start sooner than when the ink tank containing the most ink is determined after recording the current image is completed.

When the time past since the last time ink was ejected is close to the flushing time for either first nozzle row 10*a* or second nozzle row 10*b*, the recording control unit 70B in this embodiment records images by ejecting ink from the nozzle row that is close to the flushing time regardless of how much ink remains in the ink tanks.

As a result, flushing the nozzle row for which the time since the last ink ejection is close to the flushing time can be avoided, and the need to minimize nozzle flushing can be met.

A preferred embodiment of the invention is described above, and the invention is obviously not limited thereto. For example, the recording medium processed by the multifunction device 1 in the recording system 8 is not limited to checks 4, and the size of the recording media that can be used in the multifunction device 1 can be varied as desired. The foregoing embodiment also describes a configuration having two ink tanks and two nozzle rows connected 1:1 to the two ink tanks, but configurations having three or more ink tanks and nozzle rows are obviously also conceivable.

The foregoing embodiment also describes recording each check 4 using one of the nozzle rows, but the invention is not so limited. For example, in a recording device that records by page unit, images can be recorded by selecting the nozzles to use based on the amount of ink left in each ink tank by page unit. In a recording device that records one column or one line at a time, images can be recorded by selecting the nozzles to use based on the amount of ink left in each ink tank by column or by line.

The remaining ink management unit 70A could also detect the remaining amount of ink by using a photosensor to detect the position of the ink meniscus in the first ink tank 45*a* and second ink tank 45*b*.

The function units shown in the block diagram in FIG. 4 simply describe the functional configuration, but the function units do not need to be rendered with discrete hardware components, and the function of plural function units could be combined in a single hardware device, or a single function unit could be rendered with plural hardware devices, through cooperation between software and hardware components.

The program run by the CPU of the control unit 70 to perform the operations described above is not limited to being stored in the nonvolatile memory of the control unit 70, and could be stored to a removable recording medium, or stored for downloading from another device connected over a communication line, and the multifunction device 1 could download and run the program from such devices. Other aspects of the configuration can also be changed as desired.

The entire disclosure of Japanese Patent Application No: 2011-202212, filed Sep. 15, 2011 is expressly incorporated by reference herein.

What is claimed is:

1. A recording device comprising:

1) an ink cartridge comprising:

a) a first ink tank filled with ink; and b) a second ink tank that is filled with ink of the same color as the ink in the first ink tank;

2) an inkjet head comprising:

a) a first nozzle row that is connected to the first ink tank and ejects ink supplied from the first ink tank; and b) a second nozzle row that is connected to the second ink tank and ejects ink supplied from the second ink tank; and 3) recording control unit that prints on a recording medium by ejecting ink from the first nozzle row or the second nozzle row of the inkjet head, and when printing on the recording medium, determines whether the first ink tank or the second ink tank of the ink cartridge contains more ink, and prints by ejecting ink from the nozzle row connected to the ink tank containing the most ink.

2. The recording device described in claim 1, wherein the recording control unit is configured to:

receive a first control command for printing a first image, and a second control command following the first control command for printing a second image;

print the first image on the recording medium based on the received first control command and then print the second image on the recording medium based on the second subsequently received control command, and when the second control command is received while printing the first image based on the received first control command, the recording control unit is configured to determine whether the first ink tank or the second ink tank contains the most ink after the second control command has been completely received and before the first image is finished printing, and print the second image on the recording medium based on the second control command by ejecting ink from the nozzle row connected to the ink tank determined to have the most remaining ink.

3. The recording device described in claim 1, wherein:

the recording control unit receives a first control command for printing, and a second control command following the first control command, prints on the recording medium based on the received first control command and the second control command, determines whether the first ink tank or the second ink tank contains the most ink when printing based on the first control command ends if the second control command is received while printing based on the received first control command, and prints based on the second control command by ejecting ink from the nozzle row connected to the ink tank determined to have the most remaining ink.

4. The recording device described in claim 1, wherein:

the recording control unit receives a first control command for printing, and a second control command following the first control command, prints on the recording medium based on the received first control command and the second control command, determines whether the first ink tank or the second ink tank contains the most ink when receiving the second control command starts if the second control command is received while printing based on the received first control command, and prints based on the second control command by ejecting ink from the nozzle row connected to the ink tank determined to have the most remaining ink.

5. The recording device described in claim 1, wherein:

the recording control unit receives a first control command for printing, and a second control command following the first control command, prints on the recording medium based on the received first control command and the second control command, estimates the amount of ink that will be left in the first ink tank when printing based on the first control command ends, and compares the estimated amount of ink in the first ink tank with the amount of ink in the second ink tank to determine which ink tank contains the most ink if the second control command is received while ejecting ink from the first nozzle row and printing based on the received first control command, and prints based on the second control command by ejecting ink from the nozzle row connected to the ink tank determined to have the most remaining ink.

6. The recording device of claim 1, wherein the recording control unit is configured to:

monitor an amount of time since ink was last ejected from the first nozzle row;

monitor an amount of time since ink was last ejected from the second nozzle row;

compare the monitored amounts of time to a threshold time;

select the first nozzle row or the second nozzle row for printing when the associated monitored amount of time exceeds the threshold time, regardless of the volume of ink remaining in the respective ink tanks.

7. The recording device of claim 6, wherein the recording control unit is configured to:

flush the first nozzle row when the monitored amount of time exceeds a flushing time;

flush the second nozzle row when the monitored amount of time exceeds the flushing time;

wherein the flushing time is greater than the threshold time.

8. The recording device of claim 1, wherein the recording unit is further configured to receive a user input identifying a time during a printing process in which to determine the ink tank containing the most amount of ink.

9. The recording device of claim 8, wherein the user input identifies one of:

a first time, where the recording control unit determines the ink tank with the most amount of remaining ink after the control command for recording the next image has been completely received;

a second time, where the recording control unit determines the ink tank with the most amount of remaining ink after the image currently being recorded is completed;

a third time, where the recording control unit determines the ink tank with the most amount of remaining ink at the start of receiving a control command for recording a subsequent image; and a fourth time, where the recording control unit determines the ink tank with the most amount of remaining ink after (1) the control command for recording the next image has been received, (2) the recording control unit estimates the amount of ink left in each ink tank after completing the recording of the current image, and wherein the determination is based on the estimate.

10. The recording device of claim 1, wherein the recording control unit is configured to record each image by ejecting ink exclusively from either the first nozzle row or the second nozzle row.

11. A recording device comprising:

1) a cartridge comprising:

a) a first ink tank filled with ink; and b) a second ink tank that is filled with ink of the same color as the ink in the first ink tank;

2) an inkjet head comprising:

a) a first nozzle row that is connected to the first ink tank and ejects ink supplied from the first ink tank; and b) a second nozzle row that is connected to the second ink tank and ejects ink supplied from the second ink tank; and 3) a recording control unit configured to:

a) print on a recording medium by ejecting ink from the first nozzle row or the second nozzle row of the inkjet head, and b) flush the first nozzle row and second nozzle row when a time for which ink is not ejected from the respective nozzle row exceeds a specific flushing time; and c) when printing on the recording medium:

i) to print on the recording medium, first determine if the time for which ink has not been ejected by either the first nozzle row or the second nozzle row exceeds a first threshold time period when a control command is received, and when the time for which ink has not been ejected by either the first nozzle row or the second nozzle row exceeds the first threshold time period when the control command is received, print by ejecting ink from the nozzle row that exceeds this first threshold time period; and ii) when the time for which ink has not been ejected by either the first nozzle row or the second nozzle row does not exceed this first threshold time period when the control command is received, determine whether the first ink tank or the second ink tank of the ink cartridge contains more ink, and print by ejecting ink from the nozzle row connected to the ink tank containing the most ink.

12. The recording device of claim 11, wherein the recording control unit is configured to:

flush the first nozzle row when the monitored amount of time exceeds a second threshold time period;

flush the second nozzle row when the monitored amount of time exceeds the second threshold time period;

wherein the second threshold time period is associated with a flushing time and is greater than the first threshold time period.

13. The recording device of claim 11, wherein the recording unit is further configured to receive a user input identifying a time during a printing process in which to determine the ink tank containing the most amount of ink.

14. The recording device of claim 13, wherein the user input identifies one of:

a first time, where the recording control unit determines the ink tank with the most amount of remaining ink after the control command for recording the next image has been completely received;

a second time, where the recording control unit determines the ink tank with the most amount of remaining ink after the image currently being recorded is completed;

a third time, where the recording control unit determines the ink tank with the most amount of remaining ink at the start of receiving a control command for recording a subsequent image; and a fourth time, where the recording control unit determines the ink tank with the most amount of remaining ink after (1) the control command for recording the next image has been received, (2) the recording control unit estimates the amount of ink left in each ink tank after completing the recording of the current image, and wherein the determination is based on the estimate.

15. The recording device of claim 11, wherein the recording control unit is configured to record each image by ejecting ink exclusively from either the first nozzle row or the second nozzle row.

16. A non-transitory storage medium storing a program that is executed by a control unit that controls a recording device having an ink cartridge that holds a first ink tank filled with ink, and a second ink tank that is filled with ink of the same color as the ink in the first ink tank, and an inkjet head that prints using a first nozzle row that is connected to the first ink tank and ejects ink supplied from the first ink tank, and a second nozzle row that is connected to the second ink tank and ejects ink supplied from the second ink tank, the program causing the control unit to function as a recording control unit that carries out the method comprising:

receiving a first control command for printing a first image;

determining, for the first image, whether the first ink tank or the second ink tank of the ink cartridge contains more ink, and printing the first image by ejecting ink from the nozzle row connected to the ink tank containing the most ink.

17. The non-transitory storage medium of claim 16, wherein the method carried out by the recording control unit further comprises:

receiving a second control command for printing a second image; and determining, for the second image, whether the first ink tank or the second ink tank of the ink cartridge contains more ink; and wherein, when the second control command is received while printing the first image, determining, for the second image, whether the first ink tank or the second ink tank contains more ink occurs after the second control command has been completely received and before the first image is finished printing; and printing the second image based on the second control command by ejecting ink from the nozzle row connected to the ink tank determined to have the most remaining ink for the second image.

18. The non-transitory storage medium of claim 16, wherein the method carried out by the recording control unit further comprises:

prior to determining, for the first image, whether the first ink tank or the second ink tank of the ink cartridge contains more ink, determining a time for which ink has not been ejected from the first nozzle row and a time for which ink has not been ejected from the second nozzle row;

comparing the determined times to a first threshold time period; and when one of the determined times exceeds the first threshold time period, printing the first image by ejecting ink from the nozzle row that exceeds the first threshold time period.

19. The non-transitory storage medium of claim 18, wherein the method carried out by the recording control unit further comprises:

flushing the first nozzle row when the time since the first ink tank last ejected ink from the first nozzle row exceeds a second threshold time period;

flushing the second nozzle row when the time since the second ink tank last ejected ink from the second nozzle row exceeds the second threshold time period; and wherein the second threshold time period is associated with a flushing time and is greater than the first threshold time period.

20. The non-transitory storage medium of claim 16, wherein the method carried out by the recording control unit further comprises receiving a user input identifying a time during a printing process in which to determine the ink tank containing the most amount of ink.

21. The non-transitory storage medium of claim 20, wherein the user input identifies one of:

a first time, where the recording control unit determines the ink tank with the most amount of remaining ink after the control command for recording the next image has been completely received;

a second time, where the recording control unit determines the ink tank with the most amount of remaining ink after the image currently being recorded is completed;

a third time, where the recording control unit determines the ink tank with the most amount of remaining ink at the start of receiving a control command for recording a subsequent image; and a fourth time, where the recording control unit determines the ink tank with the most amount of remaining ink after (1) the control command for recording the next image has been received, (2) the recording control unit estimates the amount of ink left in each ink tank after completing the recording of the current image, and wherein the determination is based on the estimate.

22. The non-transitory storage medium of claim 16, wherein the recording control unit is configured to record each image by ejecting ink exclusively from either the first nozzle row or the second nozzle row.

* * * * *